United States Patent [19]

Kearnes et al.

[11] 4,316,491

[45] Feb. 23, 1982

[54] AUTOMATIC LOG PROCESSING APPARATUS AND METHOD

[76] Inventors: Roger M. Kearnes, 1994 W. 43rd Ave., Vancouver, B.C., Canada, V6M 2C6; Gianni Q. Scaramella, 8695 Oak St., Vancouver, B.C., Canada, V6P 4B2

[21] Appl. No.: 93,280

[22] Filed: Nov. 13, 1979

[51] Int. Cl.[3] ..... B27M 1/00; B27C 1/08

[52] U.S. Cl. ..... 144/39; 83/72; 83/367; 83/435.1; 144/312; 144/326 R; 198/434; 414/753

[58] Field of Search ..... 198/434; 83/435.1, 418, 83/420, 425.2, 367, 371, 361, 71, 72; 414/751, 753, 749; 144/3 R, 312, 326 R, 39, 41

[56] References Cited

U.S. PATENT DOCUMENTS

| | | | |
|---|---|---|---|
| 3,934,630 | 1/1976 | Cockle | 144/312 |
| 4,074,601 | 2/1978 | Warren et al. | 144/312 |
| 4,147,259 | 4/1979 | Nilsson | 414/753 |
| 4,154,330 | 5/1979 | Lucas | 198/434 |

*Primary Examiner*—W. D. Bray
*Attorney, Agent, or Firm*—Carver & Co.

[57] ABSTRACT

Apparatus for processing a log after scanning dimensionally by feeding the log along a longitudinal axis through a cutting means mounted adjacent the axis. The apparatus has a carriage mounted on rails for movement along the rails parallel to the longitudinal axis, and a clamp on the carriage which clamps the log on side faces thereof for feeding into the cutting means. The apparatus has orienting structure cooperating with the carriage and clamp to move the clamp relative to the longitudinal axis to re-position the log in a desired orientation relative to the axis and in accordance with the scanned dimensions. The cutting device initially cuts a lower datum face of the log which supports a forward end of the log when released from a respective clamp, and then cuts two side datum faces which engage guides to prevent rotation of the log after release by the clamp.

14 Claims, 13 Drawing Figures

AUTOMATIC LOG PROCESSING APPARATUS AND METHOD

BACKGROUND OF THE INVENTION

1. Field of the Invention

Figure 1:
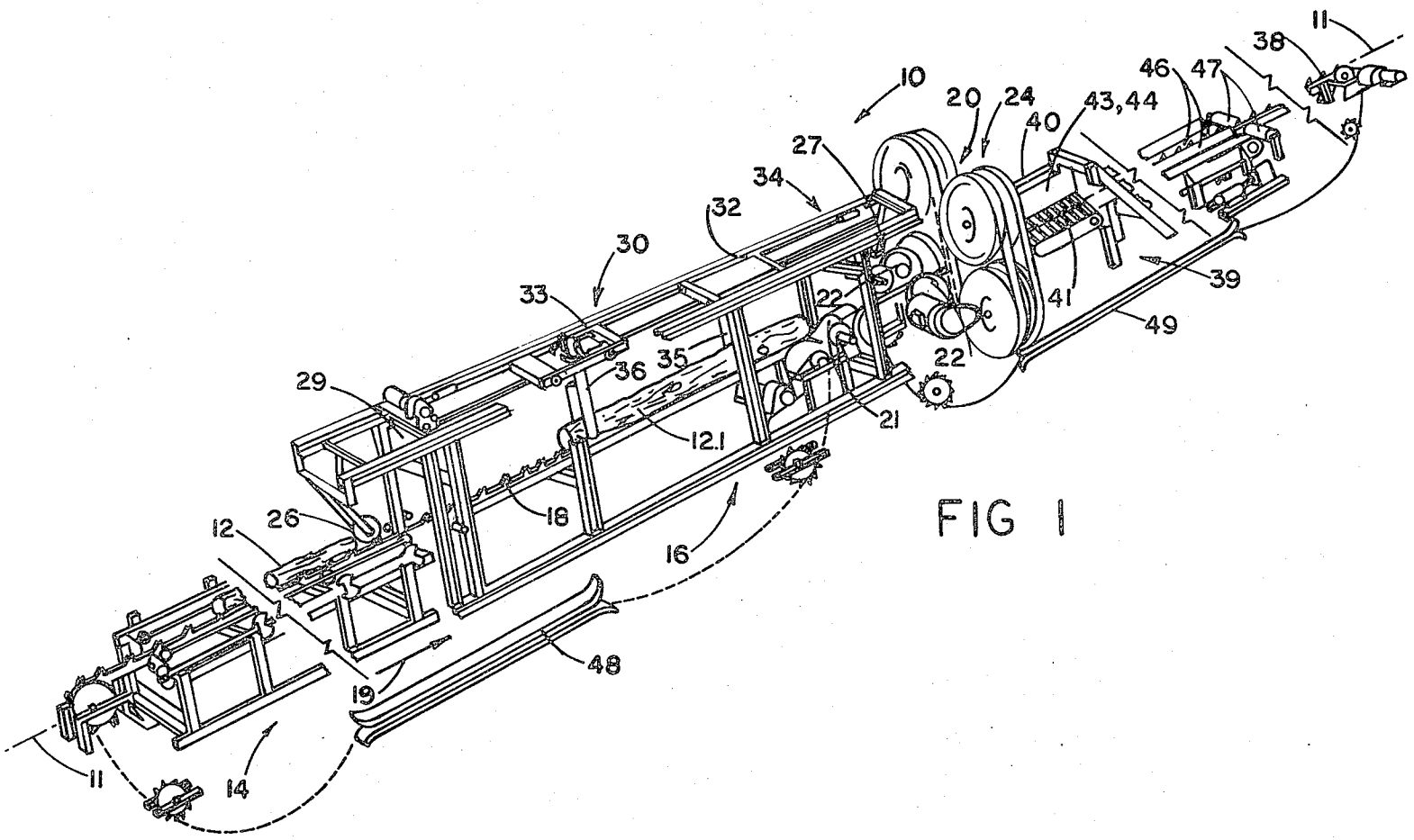

The invention relates to an apparatus and method for automatically processing logs so that the logs are processed to obtain a yield that approaches optimum for a particular cutting pattern and log shape.

2. Prior Art

Prior art automatic log processing apparatus are known, typical apparatus being shown in U.S. Pat. Nos. 3,452,246; 3,554,249 and 3,736,968, the respective inventors being Ottosson, Arnels and Mason. These patents disclose automatic apparatus for processing logs, and for some shapes of logs, optimum yield is not obtained due to the scanning and cutting limitations of the apparatus. To obtain approximate profile and length data of a log, prior art apparatus usually scan the log dimensionally in one reference place only, commonly a horizontal plane. Then, based on this data, spacing between the saws, chippers, etc. can be adjusted automatically by a control means, which is commonly a digital computer programmed to determine saw spacing for optimum yield from the data. However, such data is limited to the reference plane in which the log is scanned, and highly irregular logs, such as badly crooked logs or logs with tapers which vary considerably in different planes, cannot be cut optimally by such apparatus. One difficulty is that in such apparatus there is no provision for shifting the log in a controlled manner in a plane normal to the reference plane, eg. shifting the log vertically.

U.S. Pat. No. 4,147,259, inventor Uno B. Nilsson, discloses a feed mechanism for logs in which the logs are gripped by scissor clamps mounted on two carriages running on overhead rails. After scanning, the log is initially positioned accurately by a log charging device, and the scissor clamps are automatically "floated" to accomodate the position of the log prior to enagagement. Upon engagement by the clamps, it is assumed that there is negligible shifting of the log out of the desired orientation, so that the clamps are considered to maintain the log in the desired orientation achieved by the charging device.

SUMMARY OF THE INVENTION

The present invention reduces some of the difficulties and disadvantages of the prior art by providing a scanning means which scans logs in at least one reference plane and by providing a log holding means which permits accurate shifting of the log in a plane normal to the reference plane. Preferably the log is scanned in two mutually perpendicular refernce planes, eg. horizontal and vertical planes, to determine dimensions in both vertical and horizonal directions and thus obtain a more accurate log profile than that obtained by scanning in one plane. The log is then located in an apparatus which provides accurate shifting of the log relative to these two planes to position the log in a desired attitude relative to cutters or other processing means of the apparatus, to permit cutting or processing of the log which approaches optimum yield based on the scanning data.

An apparatus according to the invention is for processing a log after scanning the log dimensionally, after which the log is fed generally along a longitudinal axis through a cutting or processing means mounted adjacent the axis. The apparatus includes a rail means disposed parallel to the longitudinal axis and, a carriage means mounted on the rail, means for movement therealong. The apparatus is further characterized by a clamp means and an orienting means, the clamp means being mounted on the carriage means and adapted to clamp the log on side faces thereof to hold the log for feeding into the cutting means. The orienting means cooperates with the carriage means and the clamp means to move the clamp means relative to the axis to reposition the log in a desired orientation relative to the longitudinal axis in accordance with the scanned dimensions. Preferably, for long logs, the carriage means has forward and rear support carriages spaced along the rail means to support the log at two spaced locations with clamp means mounted on each support carriage. The orienting means of each carriage is independently adjustable to reposition independently portions of the log gripped by the clamp means.

A method according to the invention of processing a log relates to holding and to positioning the log prior to feeding the log parallel to a longitudinal axis of the cutting means disposed adjacent the axis. The method is characterized by successive steps as follows.

The log is positioned and scanned dimensionally in at least one plane to determine sufficient dimensions to compute a desired cutting pattern. The log is then engaged on each side thereof in at least one location, and moved relative to the longitudinal axis so as to reposition the log relative to the longitudinal axis in accordance with the desired cutting pattern. The log is then fed into a first portion of the cutting means and portions of a lower face of the log are cut to produce a lower datum face. The log is fed through a second portion of the cutting means to cut two opposed side datum faces of the log. Preferably, for a long log, the log is gripped in at least two locations spaced along the length of the log.

A detailed disclosure following, related to the drawings, describes preferred apparatus and method according to the invention which, however, are capable of expression in structure and method other than that specifically described and illustrated.

Figure 2:
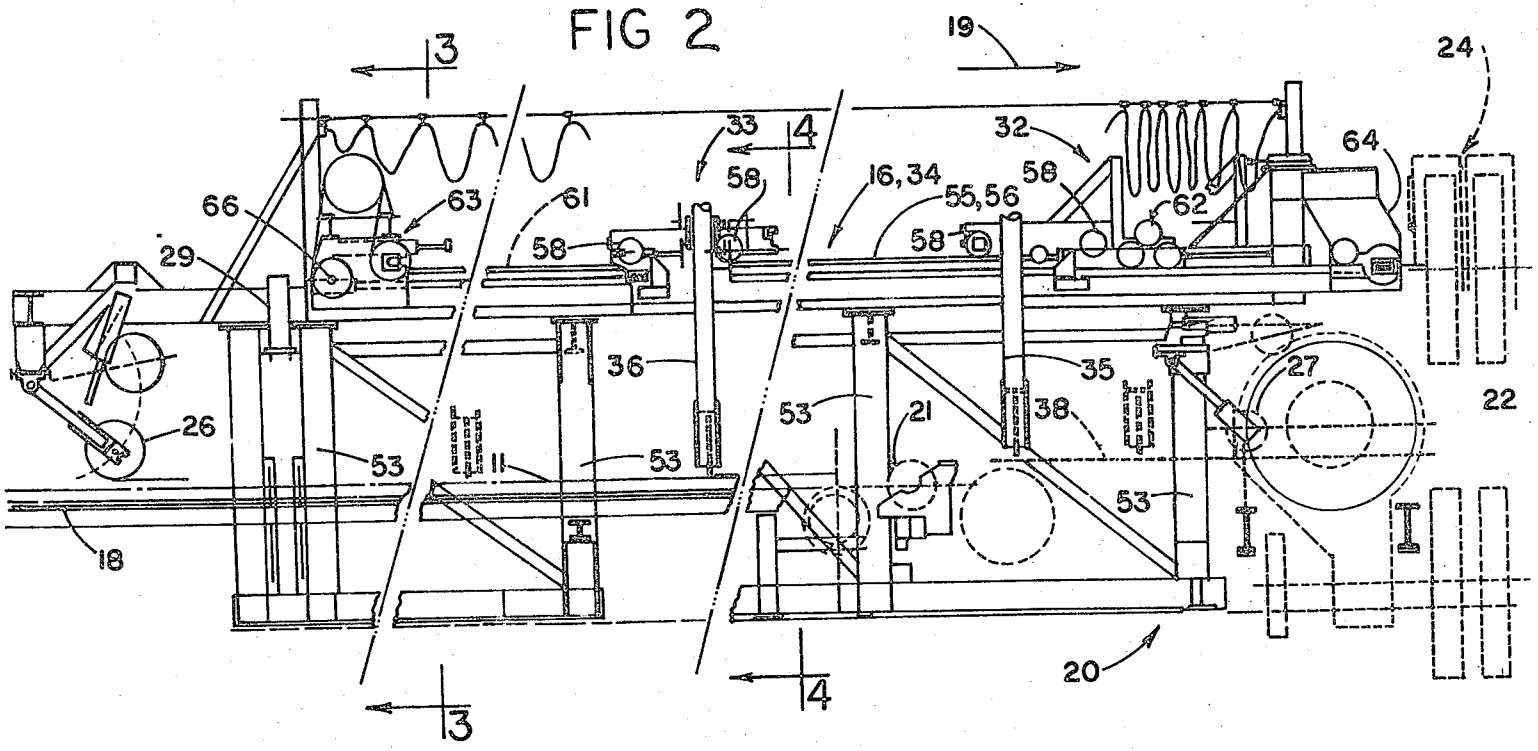
Figure 4:
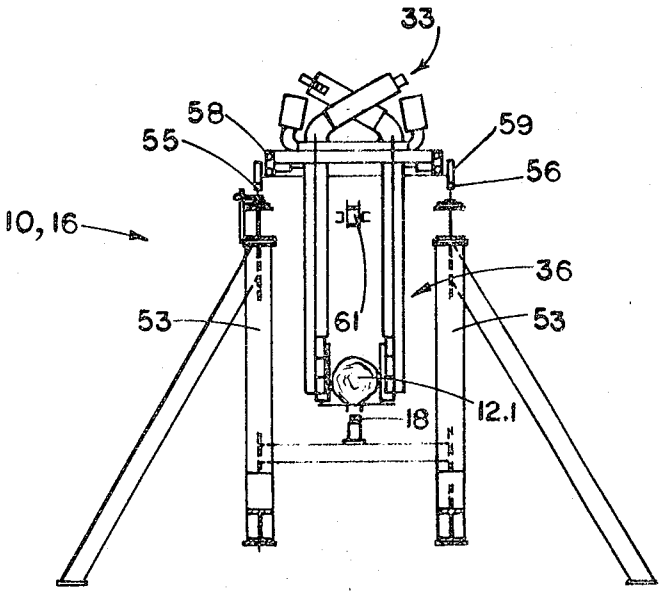
Figure 3:
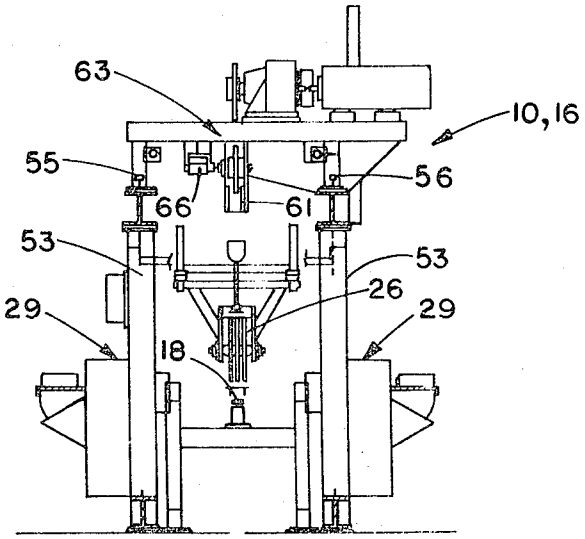
Figure 5:
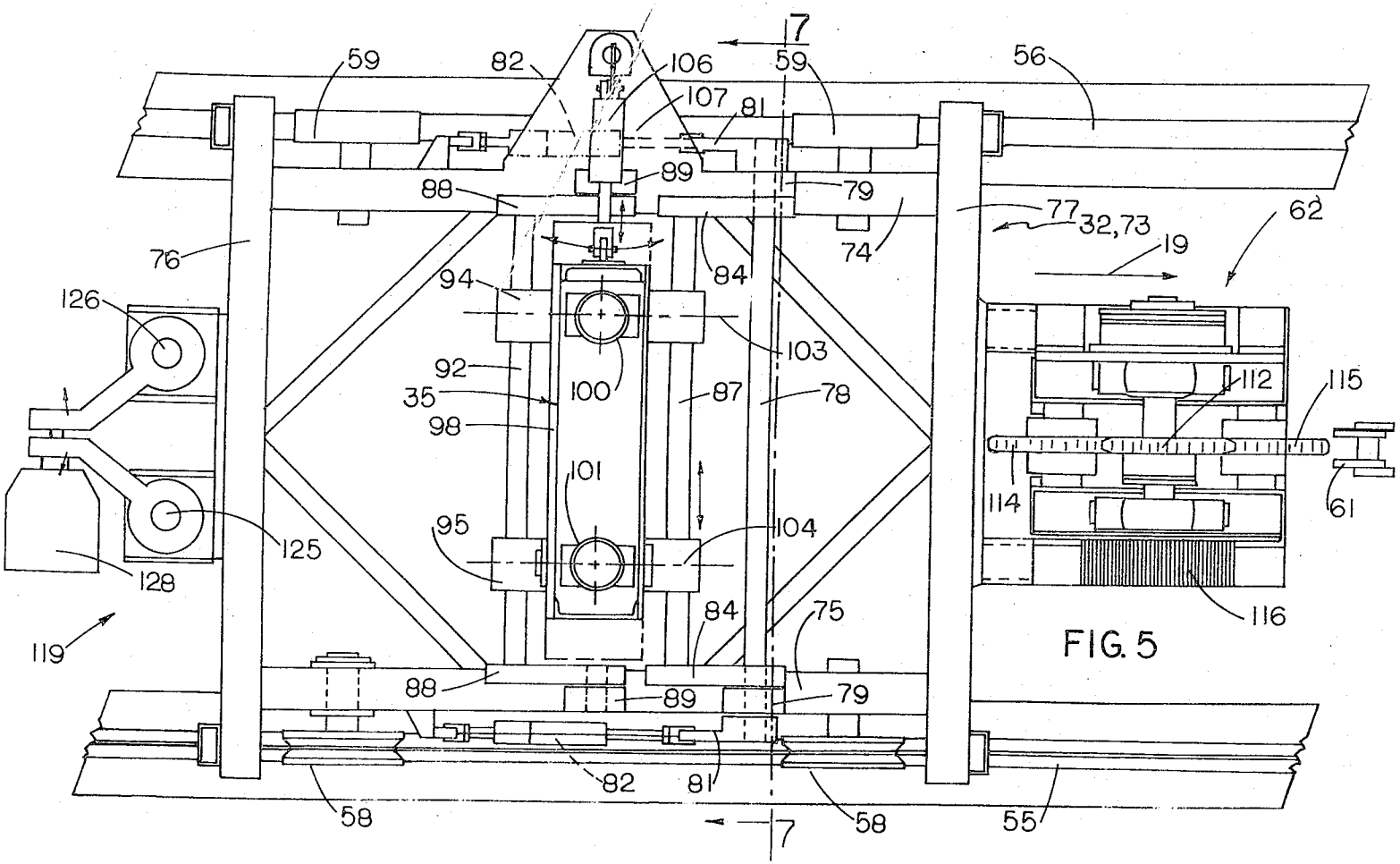
Figure 6:
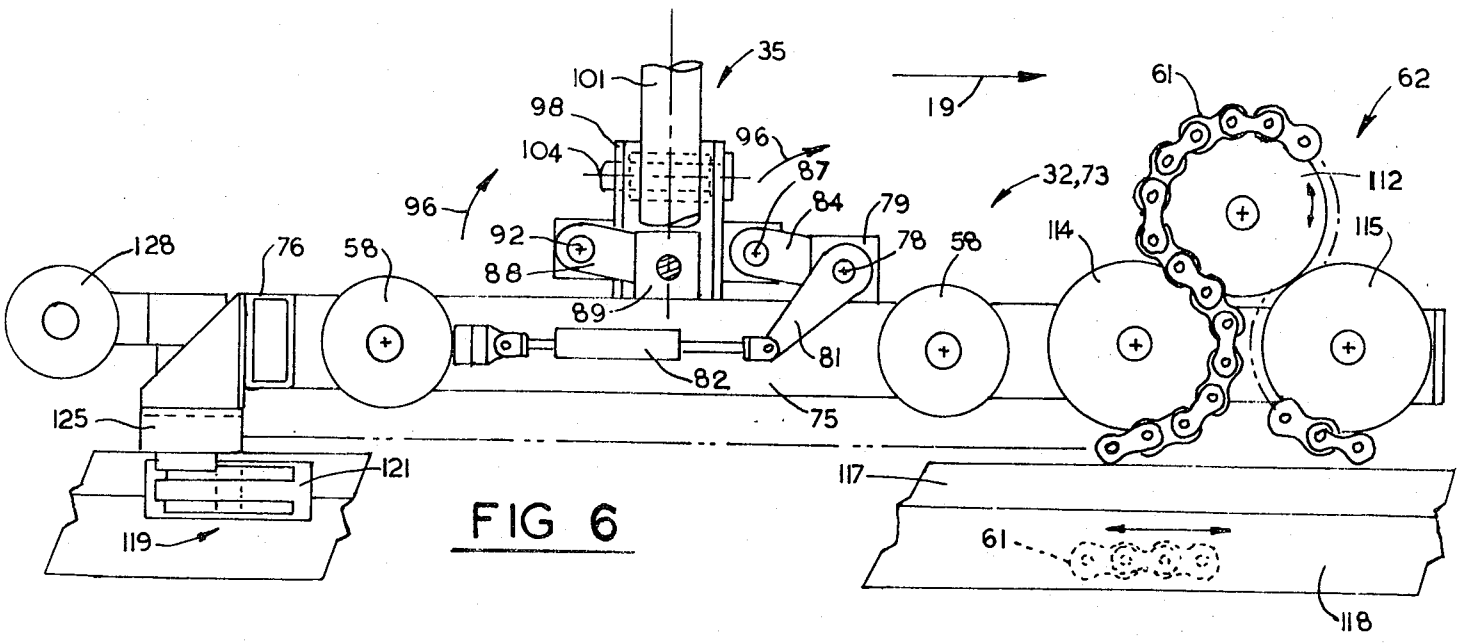
Figure 7:
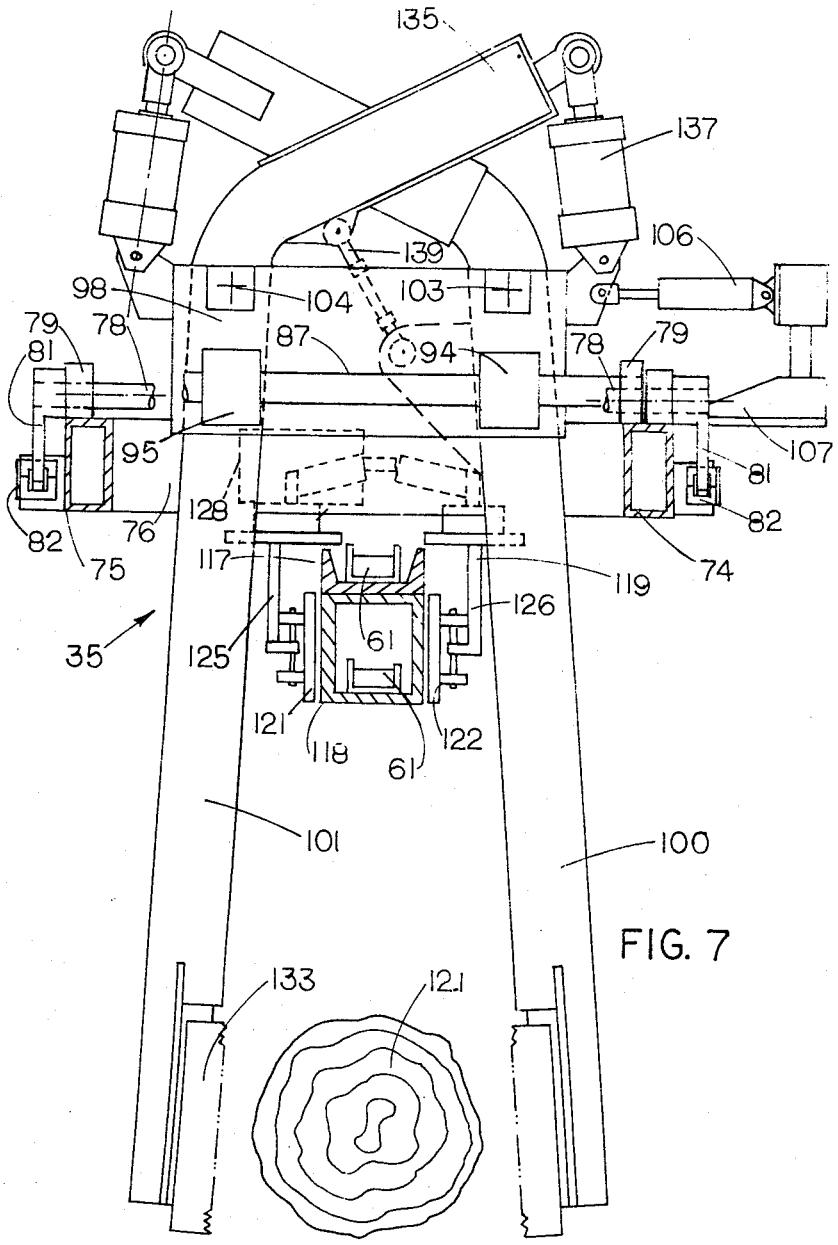
Figure 8:
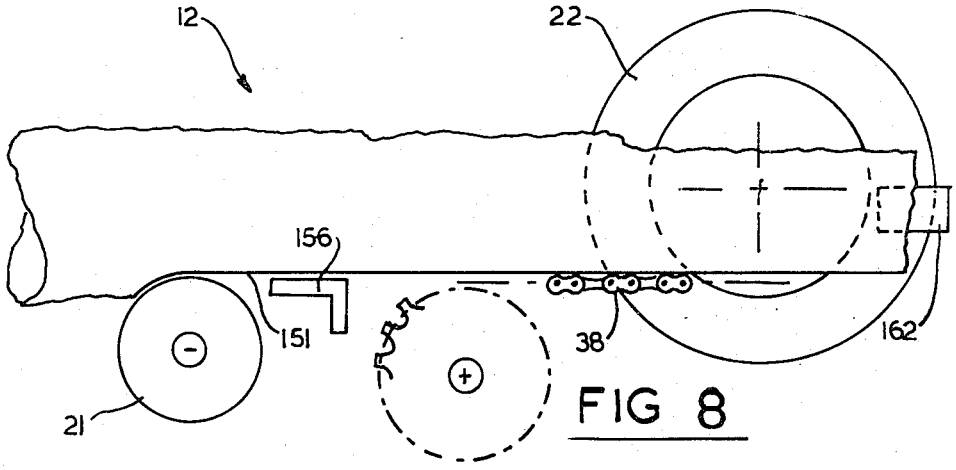
Figure 9:
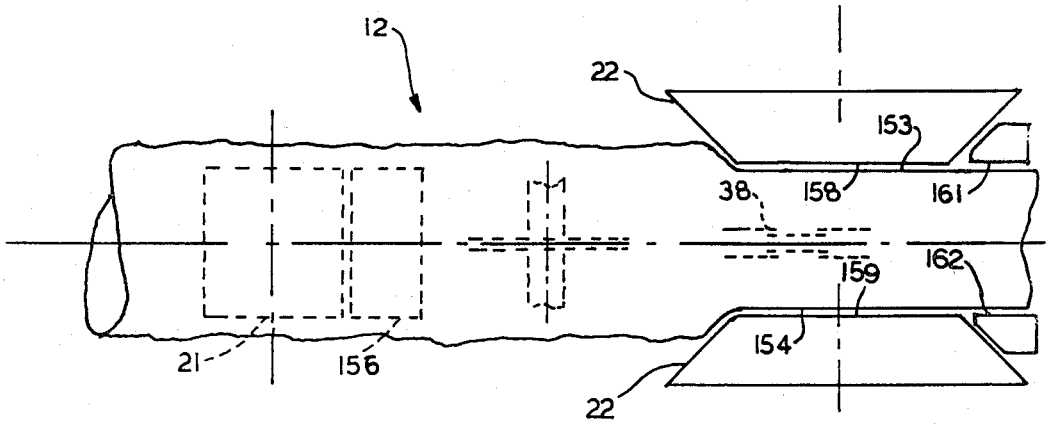
Figure 10:
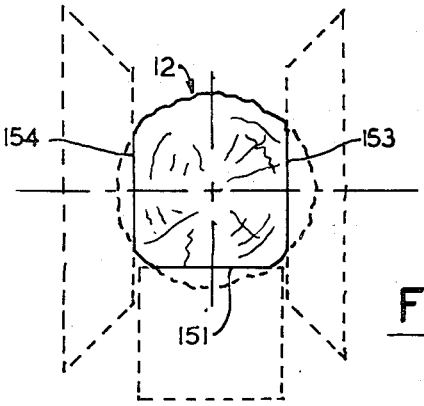
Figure 12:
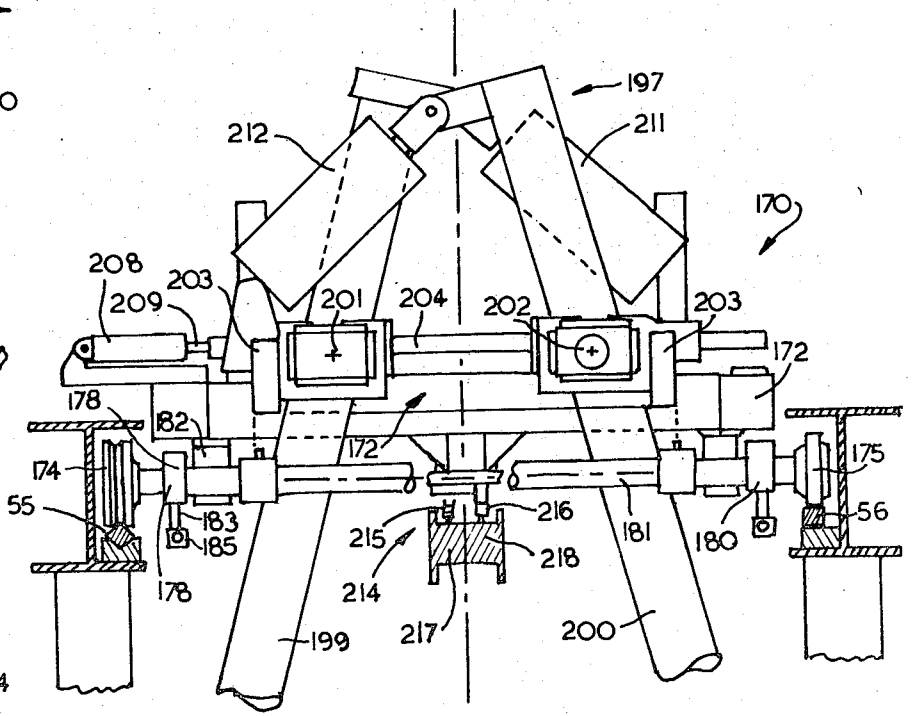
Figure 13:
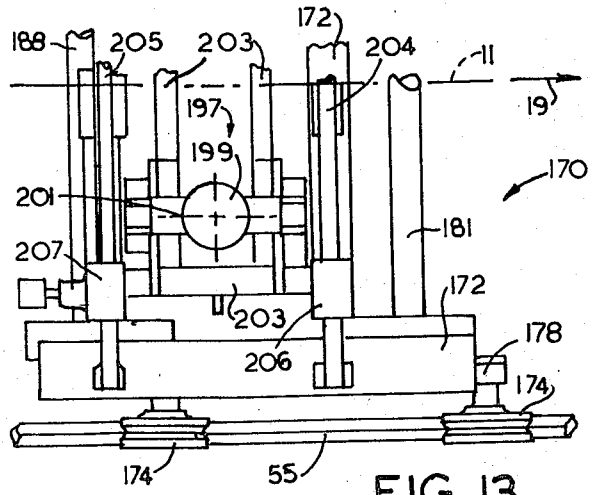
Figure 11:
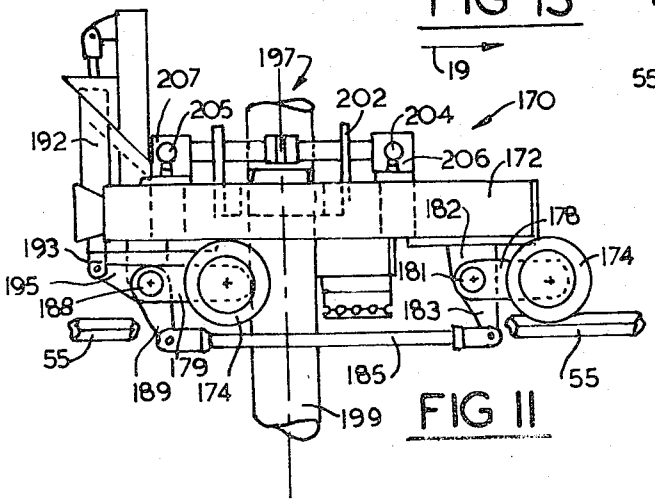

FIG. 1 is a simplified fragmented perspective of the apparatus according to the invention, FIG. 2 is a fragmented side elevation of a portion of the apparatus relating to holding, positioning and feeding means according to the invention, FIG. 3 is a simplified section on line 3—3 of FIG. 2, FIG. 4 is a simplified section on line 4—4 of FIG. 2, FIG. 5 is a simplified fragmented top plan of one carriage and a portion of rail means according to the invention, portions of the clamp means, controls, etc. being omitted, FIG. 6 is a simplified fragmented side elevation of the carriage of FIG. 5, FIG. 7 is a simplifed end elevation of the carriage of FIG. 6, some details of the clamp means being shown, FIG. 8 is a diagrammatical side elevation of major portions of the cutting means and a portion of a log, FIG. 9 is a diagrammatical top plan of major portions of the cutting means and a portion of the log of FIG. 8, FIG. 10 is a diagrammatical end elevation of a portion of the cutting means and a cross-section of a portion of the log being cut, FIG. 11 is a simplified fragmented side elevation of an alternative carriage shown on a portion of rail means, FIG. 12 is a simplified fragmented end elevation of the carriage of FIG. 11, FIG. 13 is a simplified fragmented top plan of one-half of the carriage of FIG. 11.

DETAILED DISCLOSURE

FIG. 1

An apparatus 10 according to the invention has a main longitudinal axis 11, and a log 12 is fed generally long the axis during processing. The apparatus has a log turner 14 and a log carriage support frame 16 cooperating with a spiked primary infeed conveyor chain 18, the chain being powered for feeding logs in direction of an arrow 19 along the longitudinal axis 11. A cutting means 20 is mounted adjacent the axis 11 and has a protrusion cutter 21 and a pair of opposed chipper heads 22 disposed upstream of a quad bandmill 24. Log hold down rolls 26 and 27 are fitted at upstream and downstream ends of the support frame 16 to resist upward forces on the log. A scanning means 29 is fitted at the upstream end of the support frame. The scanner can be a laser type in which the log passes through two beams at right angles to each other.

The frame 16 supports a log holding, positioning and feeding means 30 according to the invention, which includes a pair of generally similar forward and rear support carriages 32 and 33 mounted on and spaced along rail means 34 and carrying downwardly extending forward and rear scissor clamp means 35 and 36 respectively. The clamp means are adapted to grip spaced portions of the log 12 on side faces thereof, the log being shown in an advanced position designated 121, for feeding through the cutting means 20. The support carriages are adapted for longitudinal movement along the rail means which are disposed parallel to the longitudinal axis 11 and are described in greater detail with reference to FIGS. 5 through 7.

An outfeed conveyor 39 has a spiked outfeed or secondary chain 38, and a pair of hydraulically driven side slat chains 40 and 41 which feed outer pieces of sawn lumber laterally from the cutting means. Also two-position, laterally-movable, side gates 43 and 44 are located to direct the sawn lumber as required. A pair of belt beds 46 and a pair of throw-out rolls 47 positioned downstream of the slat chain straddle the outfeed chain 38 and distribute sawn lumber to other conveyors, not shown, as required. Primary and secondary chain return guides 48 and 49 support and guide returning lower runs of the respective feed chains.

The log turner 14, the scanning means 29, the chipper head pair 22, the bandmill 24, the support equipment, and the conveyors, etc. are known in the trade. A major portion of the invention relates to the log holding, positioning and feeding means 30 and the disposition of the cutting means relative thereto so as to optimize yield from a log scanned by the scanner. A computer, not shown, accepts data from the scanning means 29 which scans logs for length and for lateral dimensions both in a horizontal and a vertical plane so as to provide profiles of the log in two planes. The computer has been programmed to determine from the scanning data, the spacings of the saws and chipper head pair of the cutting means 20 to optimize yield from the particular log. The computer processes the scanning data and outputs signals which are then fed to the carriages 32 and 33 and the clamps 35 and 36 and, as will be described, position the log relative to the longitudinal axis 11. This permits optimum cutting of the log based on the data from the scanner.

FIGS. 2-4

The support 16 includes a plurality of spaced vertical posts 53 connected with undesignated horizontal and inclined supports. The rail means 34 includes a pair of spaced parallel rails 55 and 56, which are inverted vee-sectioned and flat topped respectively and are disposed parallel to and above the axis 11. Vee-grooved and flat roller pairs 58 and 59 respectively are fitted on opposite sides of the forward and rear carriages 32 and 33 to engage the rails 55 and 56 respectively for supporting and guiding the carriages along top of the rails. A drive chain 61, a centerline only of which is shown in FIG. 2, is carried on sprocket groups 63 and 64 at opposite ends of the support frame 16 so that at least one run of the chain extends along and between the rails and parallel to and above the axis 11. At least one sprocket of the group 63 or 64 is powered to serve as drive chain drive means so that the run is fed parallel to the axis 11 in direction of the arrow 19. The rear carriage 33 is secured to the chain 61 and, as will be described with reference to FIGS. 5 and 6, a clutch means 62 on the forward carriage 32 releasably connects the carriage 32 to the chain 61. When the clutch means 62 is engaged and the chain 61 is moving, the carriages 32 and 33 are fed in the same direction and speed along the rails. One of the sprockets of the group 63 has a rotary encoder 66 to count sprocket revolutions, the encoder having an output connected to the computer so as to reflect displacement of the chain, and thus indirectly, to indicate the displacement of at least the rear carriage along the frame 16 relative to a longitudinal datum.

FIGS. 5-7

The forward support carriage 32 has a first frame 73 carrying the two pairs of rollers 58 and 59 to support the first frame, the frame having longitudinal side members 74 and 75 connected by transverse end members 76 and 77. A transverse synchronizing shaft 78 extends between journals 79 connected to the side members 74 and 75. Similar arms 81 extend downwardly from ends of the shaft 78 and are connected to similar lift cylinders 82 secured to the first frame. A pair of parallel forward connecting links 84 extends from the shaft 78 to support a forward transverse guide shaft 87, and a similar pair of rear connecting links 88 extends from journals 89 carried on the frame to support a rear transverse guide shaft 92, the shafts 87 and 92 being parallel to each other. A pair of spaced clamp supports 94 and 95 extend between the guide shafts 87 and 92 and are journaled on the guide shafts with linear bushings which permit axial and rotation motion of the clamp supports relative to the guide shafts. Thus it can be seen that actuation of the lift cylinders 82 swings the pairs of connecting links 84, which through the clamp supports 94 and 95 and the links 88 causes the guide shafts to swing together to describe short arcs 96 within planes parallel to the longitudinal axis 11. This causes the guide shafts to move upwardly and simultaneously forwardly a short distance, but the forward movement is considered to be negligible compared with the upwards movement.

The above structure serves as a lift means which includes two pairs of swinging arms, each arm having an inner end journalled relative to the first frame and an outer end carrying the respective transverse guide shaft. The swinging arms are synchronized so that actuation of one pair of arms carrying one transverse guide shaft results in concurrent equivalent rotation of the other pair of arms so as to swing the transverse guide shafts in unison as in a parallelogram mechanism.

An open rectangular clamp frame 98 is carried on the two clamp supports 94 and 95 and thus is supported by the linear bushings carried on the guide shafts 87 and 92 and fits between the longitudinal side members 74 and 75. The scissor clamp 35 has a pair of similar hinged clamp arms 100 and 101 hinged relative to the clamp frame 98 to permit the arms to swing about hinge axes 103 and 104. The hinge axes are disposed parallel to and above the longitudinal axis of the apparatus and swinging the arms permits a log to be gripped between lower ends thereof. Thus the lift means cooperates with the transverse guide means to move the transverse guide shafts and clamp frame generally vertically relative to the first frame to move the clamp means in a generally vertical direction.

An off-setting cylinder 106 extends between the frame 98 and an arm 107 exxtending from the first frame so that actuation of the cylinder 106 shifts the clamp frame laterally along the guide shafts 87 and 92. Thus the cylinder 106 and shafts 87 and 92 serve as shifting means and transverse guide means respectively cooperating with the clamp frame and the first frame to provide horizontal lateral movement of the clamp frame relative to the first frame. The off-setting cylinder 106 is universally mounted to follow the longitudinal and upward movement of the frame 98 that occurs when the lift cylinders 82 are actuated. When the guide shafts are in different positions relative to the frame, a given extension of the off-setting cylinder 106 moves the clamp frame along the guide shafts a different distance but the difference in movement is negligible. The lift cylinders 82 and off-setting cylinder 106 are hydraulic positioning cylinders connected to servo-valves, not shown, which are connected to the computer. To maintain positioning accuracy, feedback transducers, not shown, cooperate with the cylinders or moving structure connected to the cylinders to reflect position of the structure being moved, the transducers generating error signals which are relayed to the servo-valves to correct position of the structure. Structure above is thus linkage means cooperating with the first frame and the clamp frame to permit relative movement therebetween to orient a clamped portion of the log relative to the longitudinal axis. In effect the linkage above serves as orienting means cooperating with the carriage means and the clamp means to move the clamp means relative to the longitudinal axis to reposition the log in a desired orientation relative to the axis in accordance with the scanned dimensions.

Except where indicated below, the rear support carriage 33 is similar to the carriage 32 and the orienting means of each carriage is independently adjustable so as to reposition independently portions of the log gripped by the clamp means. As previously stated, the rear carriage 33 is permanently secured to the drive chain 61 by obvious means, not shown, and the position of the rear carriage on the frame 16 is known by the sprocket encoder output signals. In contrast to this, the front carriage 32 is releasably connected to the drive chain 61 by the clutch means 62 which is remotely operated. The means 62 includes a frame journalling a main sprocket 112 and a pair of idler sprockets 114 and 115 spaced closely beneath and aligned with the sprocket 112. The main sprocket 112 can be braked against rotation by a remotely operated brake 116. An upper run of the drive chain 61 lies in a supporting U-sectioned chainway 117 carried on the support 16, and passes in sequence from the chainway around the sprockets 114, 112 and 115 and is returned to the chainway. A returning lower run of the chain runs within a hollow support 118 carrying the chainway 117. It can be seen that when the brake 116 is released, the clutch means 62 is effectively disengaged and the sprocket 112 freewheels with movement of the chain and the carriage 32 is stationary. When the brake 116 is actuated and the clutch means 62 is effectively engaged, this causes the carriage 32 to move with the chain as if permanently secured thereto. A caliper brake assembly 119 is mounted on the carriage and has a pair of caliper arms 125 and 126 carrying at outer ends thereof respective brake shoes 121 and 122 which engage side faces of the support 118 when a brake actuator 128 cooperating with the arms is actuated. Thus it can be seen that the rear support carriage is permanently connected to the drive chain and the forward support carriage has clutch means cooperating with the drive chain to releasably connect the forward carriage to the drive chain. By driving the chain to move the rear carriage whilst the remaining first carriage is disconnected, it can be seen that spacing between carriages is varied so as to accomodate logs of different lengths.

Referring only to FIG. 7, the clamp arms 100 and 101 are generally similar and thus the arm 100 only will be described. The arm 100 has a lower end 133 having teeth or other means to grip a side face of the log 12.1, and an upper end 135 connected to a clamping cylinder 137 mounted on the clamp frame 98. An equalizing linkage 139 extends between the clamp arms 100 and 101 to ensure that the arms actuate equally and symmetrically about a central axis of the clamp. Other means to actuate the arms and to equalize movement of the arms can be substituted.

FIGS. 8–10

Portions of the log 12 and the cutting means 20 are shown diagrammatically to illustrate the cutting sequence as followed by the cutting means 20. The protrusion cutter 21 cuts a flat lower face 151 of the log initially and this is followed by the opposed chippers 22 which produce parallel side faces 153 and 154 of the log which are normal to the face 151. The face 151 is sufficiently deep to provide a lower datum face for the forward end of the log for initial locating and supporting the log. It follows that the log is disposed relative to the horizontal plane so that a rear portion of the log has at least one other similar lower face produced by the cutter 21 as the rear portion of the log passes through the cutting means. Thus the face 151 does not necessarily extend the full length of the log. A short horizontal anvil 156 is disposed downstream from the cutter 21 to contact the face 151 and support the forward end, and later the rear end.

As the forward portion of the log passes through the cutting means, the secondary chain 38 engages and supports the forward end and provides a continuation of the feed force on the log. The chipper heads 22 have plane rotating chipper faces 158 and 159 which engage the faces 153 and 154 of the log, which faces can thus be seen to be two side datum faces. Two fixed vertical guides 163 and 162 are provided downstream and closely adjacent the chipper heads to engage the faces 153 and 154. The guides have vertical faces which are essentially coplanar with the faces 153 and 154 and thus resemble guide structure of U.S. Pat. No. 3,692,074 and move with the chipper heads when chipper spacing is changed. Thus initially the forward end of the log is supported by the horizontal anvil and is prevented from rotating by a combination of the rotating faces of the chipper heads, and the adjacent fixed guides 161 and 162, and the rear clamp when engaged.

OPERATION

Initially, the log 12 is fed onto the log turner 14 and rotated by conventional log turning means to position the log in the desired orientation prior to positioning on the primary feed chain 18. The log is dropped onto the feed chain 18 which feeds the log generally along the axis 11 in direction of the arrow 19. After the log passes under the hold down roll 26, it is scanned in two planes by the scanner 29, output from which is fed into the computer which determines, from its program, optimum cutting patterns for that particular log. The log passes into the log carriage support structure 16 where it passes between the forward and rear clamps 35 and 36. The carriages have been positioned and are braked on the rails at a computed location based on log length and the infeed chain 18 is stopped. The carriages are positioned relative to the log prior to picking the log off the primary chain so that a forward portion of the log projects beyond the forward clamp about 1 meter and the rear portion of the log projects rearwardly from the rear clamp a known distance of between about 0.15 meters to 0.70 meters. The log is gripped so that a forward end thereof protrudes sufficiently to be accepted in the first portion of the cutting means without materially disturbing position of the log relative to the longitudinal axis prior to cutting the lower datum surface. The clamps are actuated to grip side faces of the log, and the clamps are then raised by the lift cylinders thus lifting the log clear off the chain.

By this time data from the computer has been processed and output signals are fed to the servovalves controlling the lift cylinder to dictate the amount of vertical movement of lift given to each end of the log. Similarly output signals are fed to the off-setting cylinders of each carriage and result in horizontal or lateral movement of the clamps. The combination of these signals causes the log to be re-aligned relative to the axis 11. Thus the forward and rear ends of the log are moved vertically or/and shifted laterally to obtain a desired disposition of the log relative to the longitudinal axis 11. The log has thus been removed from the primary chain so that it hangs from the forward and rear carriages and its disposition or relative attitude is dictated by the lift and off-setting cylinders of each carriage. The clutch means 62 of the forward carriage is then engaged and the drive chain 61 is started to feed the carriages simultaneously in the direction of the arrow 19 towards the cutting means 20.

Initially the protrusion cutter 21 cuts the lower face 151 on the forward end of the log and shortly thereafter the two chipper heads cut the opposite side faces 153 and 154. As the forward carriage 32 approaches the cutting means 20, the clamp 35 is disengaged, thus releasing a forward grip on the log, the clutch 62 is released to disengage the carriage 32 from the drive chain 61, and the carriage 32 is braked to be stationary. After disengagement, weight of the forward end of the log is supported by the lower face 151 resting on the anvil 156, and lateral or rotational movement of the log is prevented by the rotating faces 158 and 159 of the chippers and the fixed vertical guides 162 and 163 engaging the side datum faces 153 and 154. Meanwhile, the rear clamp on the rear carriage holds the rear portion of the log and moves towards the cutting means, thus feeding the log and maintaining alignment of the rear end of the log, whilst the forward end is carried by the outfeed chain 38 through the quad bandmilll. As the rear carriage approaches the stationary front carriage, the rear clamp means 36 is released and by now the outfeed chain 38 feeds the remaining rear portion of the log through the cutting means. A lower datum face, not shown, adjacent the rear portion of the log is cut and, similarly to the lower face 151, is carried on the anvil 156 prior to engaging the chain 38, thus supporting the rear end of the log after being released from the rear clamp. The chain 61 is stopped to stop the carriage 33 and when sawing is completed the sawn lumber is discharged on the outfeed conveyor as is well known in the art.

Thus, in summary, it can be seen that the method of the invention includes the following steps. The log is positioned and scanned dimensionally in at least one plane to determine sufficient dimensions to compute a desired cutting pattern. The log is then engaged on each side thereof at at least one location, and moved relative to the longitudinal axis so as to reposition the log relative to the longitudinal axis in accordance with the desired cutting pattern. The log is then fed into a first portion of the cutting means and a portion of a lower face of the log is cut to produce a lower datum face. The log is then fed through a second portion of the cutting means to cut two side datum faces of the log. Preferably, especially for long logs, the log is gripped at at least two locations spaced along the length of the log, and the log is moved at at least one of the locations to reposition the log at that location so that the log is disposed in a desired orientation relative to the longitudinal axis.

ALTERNATIVES AND EQUIVALENTS

Alternative structures utilizing the principle of the invention can be devised. For example, the structure as shown can handle logs having lengths within a range of from about 3 meters to 9 meters, and from a minimum log diameter at the top of about 10 centimeters to a maximum butt diameter of about 55 centimeters. In such an apparatus it is preferable to provide two support carriages which support the log adjacent each end, but if considerably shorter logs were to be processed a single carriage with two spaced clamps, or a single carriage with one clamp, could be substituted. The single clamp could support the log adjacent at midpoint thereof and may have one arm with a cradle providing spaced points of contact, with an opposite arm to force the log into the cradle. The cradle could then be moved to position the log in the computed orientation. Thus one or more support carriages serve as carriage means, and one or more scissor clamps or equivalent serve as clamp means mounted on the carriage means.

Similarly, a transverse infeed of the log through an alternative transverse scanning system and into the carriage structure can be substituted for the longitudinal infeed and longitudinal scanning means as described. Similarly, equivalent cutting means can be substituted for the chippers and quad bandmill as illustrated, and equivalent support means, drive means, and brake means for the two carriages can be substituted.

A major aspect of the invention relates to the orienting means which permits the clamp means to be moved in two planes relative to carriage means. An alternative orienting means is described as follows and can be substituted for that previously described.

FIGS. 11-13

An alternative support carriage 170 has an alternative first frame 172 supported on aligned pairs of vee-grooved rollers 174 and flat rollers 175 running on the respective complementary rails 55 and 56. The vee-grooved rollers 174 are mounted on forward and rear swinging arms 178 and 179, and the flat rollers 175 are mounted on similar arms on an opposite side of the first frame, one arm 180 being shown in FIG. 12. The arm 178 has an inner end secured to a transverse synchronizing shaft 181 journalled in a bracket 182 extending downwardly from the frame 172. A synchronizing lever 183 extends downwardly from the shaft 181 and carries a longitudinal connecting link 185. The rear swinging arm 179 has an inner end similarly secured to a rear transverse synchronizing shaft 188, which similarly has a synchronizing lever 189 connected to an opposite end of the connecting link 185. On an opposite side of the carriage, the flat rollers 175 are similarly mounted on equivalent swinging arms connected at opposite ends of the forward and rear transverse synchronizing shafts 181 and 188. Thus the forward and rear rollers are effectively coupled together by the shafts 181 and 188 and the link 185 for swinging movement relative to the first frame.

A lift cylinder 192 is fitted at a rear end of the support carriage 170 and has a ram 193 connected to a lift lever 195 secured to the rear shaft 188. It can be seen that actuation of the lift cylinder 192 rotates the rear shaft 188 which, through the connecting link, simultaneously causes swinging movement between the swinging arms and the first frame resulting in vertical movement of the frame 172 relative to the rails.

The carriage 170 has an alternative scissor clamp 197 having a pair of hinged clamp arms 199 and 200 and a clamp frame 203. The arms are hinged relative to the clamp frame 203 for swinging about respective hinge axes 201 and 202 for gripping a log, not shown, therebetween. The clamp frame 203 is carried on a pair of spaced parallel forward and rear guide shafts 204 and 205 extending transversely across the first frame 172. One side of the clamp frame has linear bushings 206 and 207 carried on the shafts 204 and 205 to permit transverse movement of the clamp frame across the carriage. Similar linear bushings are fitted on the opposite side of the clamp frame. A traversing cylinder 208, FIG. 12 only, is secured to the first frame and has a ram 209 cooperating with the clamp frame 203 so that actuation of the cylinder 208 shifts the clamp laterally. Clamp actuating cylinders 211 and 212 extend between the clamp frame and upper ends of the hinged arms so that actuation of the clamp cylinders swings the clamp arms to grip or release a log held therebetween as in the previous embodiment.

An alternative drive chain 214 has runs 215 and 216 lying side by side in respective chain ways 217 and 218 between the rails 55 and 56. The chain is driven and the alternative forward carriage is engaged or disengaged by a clutch means thereon, not shown, for moving and stopping the forward carriage in a manner similar to that previously described. An alternative rear carriage also runs on the rails and is permanently connected to the chain. Operation of the alternative forward and rear support carriages follows closely that of the previous carriage means and is deemed equivalent.

Thus, it can be seen that the swinging arms, the synchronizing shafts and levers, the connecting link and associated structure serve as swinging arm means journalled to the first frame and carrying the rollers engaging the rails so that the swinging arm means are synchronized for equal simultaneous movement. It can be seen that swinging the arms mounting the axles of the rollers moves the first frame generally vertically relative to the rail means to orient the clamp vertically relative to the longitudinal axis. Also, the transverse guide shafts 204 and 205 and the traversing cylinder 208 serve as transverse guide means and shifting means respectively cooperating with the clamp frame and the first frame to provide horizontal lateral movement of the clamp frame relative to the first frame. Other mechanical equivalents of the orienting means as above described can be substituted.

We claim:

1. An apparatus for processing a log, after scanning dimensionally, by feeding the log along a longitudinal axis through a cutting means mounted adjacent the axis, the apparatus having: a rail means disposed parallel to the longitudinal axis, and a carriage means mounted on the rail means for movement therealong, the apparatus being further characterized by:

(a) clamp means mounted on the carriage means and adapted to clamp the log on side faces thereof to hold the log for feeding into the cutting means, (b) orienting means cooperating with the carriage means and the clamp means to move the clamp means relative to the longitudinal axis to reposition the log in a desired orientation relative to the axis in accordance with the scanned dimensions.

2. An apparatus as claimed in claim 1, further characterized by:

(a) the carriage means having forward and rear support carriages spaced along the rail means, (b) clamp means mounted on each support carriage to grip spaced portions of the log, (c) the orienting means of each carriage being independently adjustable so as to reposition independently portions of the log gripped by the clamp means.

3. An apparatus as claimed in claim 1 in which the clamp means is further characterized by:

(a) a scissor clamp having a pair of hinged arms journalled for rotation relative to the carriage means.

4. An apparatus as claimed in claim 3 further characterized by:

(a) the hinged arms of the scissor clamp being journalled for rotation about respective hinge axis disposed parallel to and above the longitudinal axis of the apparatus.

5. An apparatus as claimed in claim 1 further characterized by:

(a) the carriage means having a support carriage having a first frame with rollers engaging the rail means to support the first frame, (b) the clamp means having a pair of hinged clamp arms and a clamp frame, the clamp arms being hinged relative to the clamp frame for swinging thereabout to grip the log therebetween, and the orienting means is further characterized by:

(c) linkage means cooperating with the first frame and the clamp frame to permit relative movement therebetween to orient a clamped portion of the log relative to the longitudinal axis.

6. An apparatus as claimed in claim 5 in which the linkage means is further characterized by:

(a) transverse guide means and shifting means cooperating with the clamp frame and the first frame to provide horizontal lateral movement of the clamp frame relative to the first frame, (b) lift means cooperating with the transverse guide means to move the transverse guide means generally vertically relative to the first frame to move the clamp means in a generally vertical direction.

7. An apparatus as claimed in claim 6 further characterized by:

(a) the transverse guide means including a pair of spaced parallel cylindrical shafts, (b) the clamp frame including at least two linear bushings, each bushing being carried on a respective transverse guide shaft to provide lateral sliding movement of the clamp frame along the shafts, (c) the lift means including two pairs of swinging arms, each arm having an inner end journalled relative to the first frame and an outer end carrying the respective transverse guide shaft, the swinging arms being synchronized so that actuation of one pair of arms carrying one transverse guide shaft results in concurrent equivalent rotation of the other pair of arms so as to swing the transverse guide shafts in unison as in a parallelogram mechanism, so as to orient the clamp means relative to the longitudinal arms.

8. An apparatus as claimed in claim 1 further characterized by:

(a) the carriage means having a first frame with rollers engaging the rail means to support the first frame, (b) the clamp means having a pair of hinged arms and a clamp frame, the arms being hinged relative to the clamp frame for swinging thereabout to grip the log therebetween, and the orienting means is further characterized by:

(c) transverse guide means and shifting means cooperating with the clamp frame and the first frame to provide horizontal lateral movement of the clamp frame relative to the first frame, (d) swinging arms means journalled to the first frame and carrying the rollers engaging the rails, the swinging arm means being synchronized for equal simultaneous movement so that swinging the arms of the rollers moves the first frame vertically relative to the rail means to orient the clamp means vertically relative to the longitudinal axis.

9. An apparatus as claimed in claim 2, further characterized by:

(a) a drive chain extending along the rail means and drive chain drive means to move the chain, (b) the rear support carriage being permanently connected to the drive chain, and the forward support carriage having clutch means cooperating with the drive chain to releasably connect the forward carriage to the drive chain, so as to vary spacing between the carriages to accomodate logs of different lengths, (c) means cooperating with the drive chain to indicate displacement of the rear carriage relative to a longitudinal datum.

10. A method of processing a log by holding and positioning the log prior to feeding the log parallel to a longitudinal axis of the cutting means disposed adjacent the axis, the method being characterized by steps of:

(a) positioning and scanning the log dimensionally in at least one plane to determine sufficient dimensions to compute a desired cutting pattern, (b) engaging the log on each side thereof in at least one location, (c) moving the log relative to the longitudinal axis so as to reposition the log relative to the longitudinal axis in accordance with the desired cutting pattern, (d) feeding the log into a first portion of the cutting means and cutting portions of a lower face of the log to produce a lower datum face, (e) feeding the log through a second portion of the cutting means to cut two opposed side datum faces of the log.

11. A method as claimed in claim 10, further characterized by:

(a) gripping the log in at least two locations spaced along the length of the log, (b) moving the log at at least one of the locations to reposition the log at that location so that the log is disposed in a desired orientation relative to the longitudinal axis.

12. A method as claimed in claim 11, further characterized by:

(a) after producing a portion of the lower datum face and portions of the two opposed side datum faces of the log in the cutting means, releasing a forward grip on the log and supporting the log on the lower datum face thereof, and engaging the side datum faces thereof so as to maintain alignment of the log.

13. A method as claimed in claim 12, further characterized by:

(a) gripping the log so that a forward end thereof protrudes sufficiently to be accepted in the first portion of the cutting means without materially disturbing position of the log relative to the longitudinal axis prior to cutting the lower datum surface.

14. A method as claimed in claim 13, further characterized by:

(a) locating the log by the lower flat and side datum faces to permit releasing of the forward end without materially disturbing alignment of the log, (b) simultaneously feeding and aligning the log from a position adjacent a rear end thereof.

* * * * *

UNITED STATES PATENT AND TRADEMARK OFFICE

CERTIFICATE OF CORRECTION

PATENT NO. : 4,316,491

DATED : February 23, 1982

INVENTOR(S) : Roger Martin Kearnes et al

It is certified that error appears in the above—identified patent and that said Letters Patent is hereby corrected as shown below:

On the Title page Item [73] Assignee should read as follows:

-- Kockums Industries Limited, Surrey, British Columbia Canada --.

Signed and Sealed this

*First* Day of *June 1982*

[SEAL]

*Attest:*

GERALD J. MOSSINGHOFF

*Attesting Officer*

*Commissioner of Patents and Trademarks*